United States Patent [19]

Hertz et al.

[11] 3,975,602

[45] Aug. 17, 1976

[54] ARC QUENCHING ARRANGEMENT FOR A GAS FLOW CIRCUIT BREAKER

[75] Inventors: Walter Hertz, Erlangen-Buchkenhof; Jan Stroh, Erlangen, both of Germany

[73] Assignee: Siemens Aktiengesellschaft, Munich, Germany

[22] Filed: Feb. 13, 1975

[21] Appl. No.: 549,776

[30] Foreign Application Priority Data

Mar. 12, 1974 Germany ..... 2411897

[52] U.S. Cl. ..... 200/148 A

[51] Int. Cl.[2] ..... H01H 33/88

[58] Field of Search ..... 200/148 A, 150 G

[56] References Cited

FOREIGN PATENTS OR APPLICATIONS 707,000 3/1965 Canada ..... 200/148 A

*Primary Examiner*—Robert S. Macon

*Attorney, Agent, or Firm*—Kenyon & Kenyon Reilly Carr & Chapin

[57] ABSTRACT

In a quenching arrangement in a gas flow circuit breaker of the type which has at least one check valve in a flow channel leading through a portion of the insulating material to the quenching gap, at least one overflow channel having therein a pressure relief valve is installed parallel to the quenching gap to couple the higher pressure chamber in which the quenching gas is contained with the low pressure chamber to which gas discharges after quenching.

9 Claims, 2 Drawing Figures

ARC QUENCHING ARRANGEMENT FOR A GAS FLOW CIRCUIT BREAKER

BACKGROUND OF THE INVENTION

This invention relates to gas flow circuit breakers in general and more particularly to an improved arc quenching arrangement for a blast piston circuit breaker.

A blast piston circuit breaker in which a check valve is installed in a flow channel leading through a portion of the insulating material to the quenching gap is disclosed in U.S. Application Ser. No. 454,544 filed Mar. 25, 1974 and assigned to the same assignee as the present invention. In such a circuit breakers sulfurhexafluoride $SF_6$, which is typically used as an insulating medium in encapsulated high voltage installations, is often used at the same time as the quenching medium. Gas flow circuit breakers of this nature are typically used in high voltage installations for quenching arcs in circuits carrying high currents. As disclosed in the aforementioned application a plurality of check valves in appropriately designed flow canals can be used to obtain the required quenching. Alternatively, the quenching or flow channel can also be designed in the form of an annular channel having a fairly large number of resilient reeds each serving the purpose of a check valve.

In such a device the pressure in the quenching medium which is required to quench the arc is generated during the motion of the circuit breaker by a blasting piston device in the quenching arrangement. In the aforementioned application a nozzle quenching system is formed by the check valves in which the pressure generated by the arc in the quenching gap is utilized for self-blasting of the arc. The check valves prevent hot quenching gasses from flowing back into the high pressure chamber i.e. the compression chamber in the blasting piston circuit breaker. Through this arrangement the excess pressure generated by the arc in the quenching gap cannot act upon the piston. As a result the circuit breaker need only be designed for a limited gas pressure.

However, in such an arrangement after the check valves in the flow channels are closed by the pressure generated at the arc in the quenching gap during interruption of the circuit, and particularly when large currents are interrupted, the gas in the high pressure section is further compressed due to motion of the piston which continues. This work of compression must, of course, be supplied by a drive mechanism.

It has been discovered that, due to the coupling between the movable electrode and the piston, an excessively high compression can be built up in the high pressure chamber between the time when the check valve closes and the time when it is re-opened. Because the electrode and piston are tied together, piston motion is determined only by the required electrode velocity. Because of these factors the drive mechanism of a quenching system of this nature must be designed to take into account the high compression in the high pressure chamber which may result during such operation. However, such high pressures are not required and not utilized during the quenching process.

In view of these problems it is the object of the present invention to limit the pressure generated in the high pressure chamber to a value required to quench the arc once the back pressure has been relieved and the check valve re-opened.

SUMMARY OF THE INVENTION

This object is accomplished in the present invention by the provision of at least one overflow relief valve in a overflow channel parallel to the quenching gap. The quenching gap separates the high pressure chamber from one or more low pressure chambers during quenching, the gas being discharged to those low pressure chambers after its quenching action. Thus, the overflow channel and overflow relief valve coupled the high pressure chamber in which the pressure for quenching is being generated to the low pressure chambers of the circuit breaker. To establish the required limited value of pressure the overflow valve is a relief valve adjusted to relieve the pressure at a predetermined value. Through this arrangement the overflow channels bypass the quenching gap and the pressure relief valve opens when a predetermined excess pressure in the compression chamber is exceeded. The gas is thus enabled to pass directly from the high pressure to the low pressure chambers of the quenching arrangement without going through the quenching gap. The pressure at which the relief valve is adjusted to open is selected so that arc quenching will still be assured once the back pressure is relieved and the check valves reopened. Through the arrangement of the present invention the drive mechanism for the blasting piston and the high pressure section of the quenching arrangement need only be designed for this limited pressure.

In accordance with one illustrated embodiment, overflow channels containing pressure relief valves are disposed in the insulating portion parallel to the flow canals containing the check valve. In this embodiment the insulating portion is mounted to the movable electrode of the breaker and is used as the blasting piston for the quenching arrangement.

It is however also possible to place the pressure relief valve in the cylinder wall of the movable electrode which is in the form of a hollow cylinder and whose interior communicates with the low pressure chamber of the quenching arrangement. In addition, pressure relief valve may also be placed in a partition between the high and low pressure chambers of the circuit breaker.

The number of relief valves should be selected so that the total cross-sectional flow area which is available upon opening is sufficient to permit the gas volume displaced by the moving piston to discharge without noticeable flow resistance. Such can be accomplished through the use of one or a few large profile valves or with a correspondingly greater number of valves of smaller profile.

DETAILED DESCRIPTION OF THE PREFERRED EMBODIMENT

Figure 1:
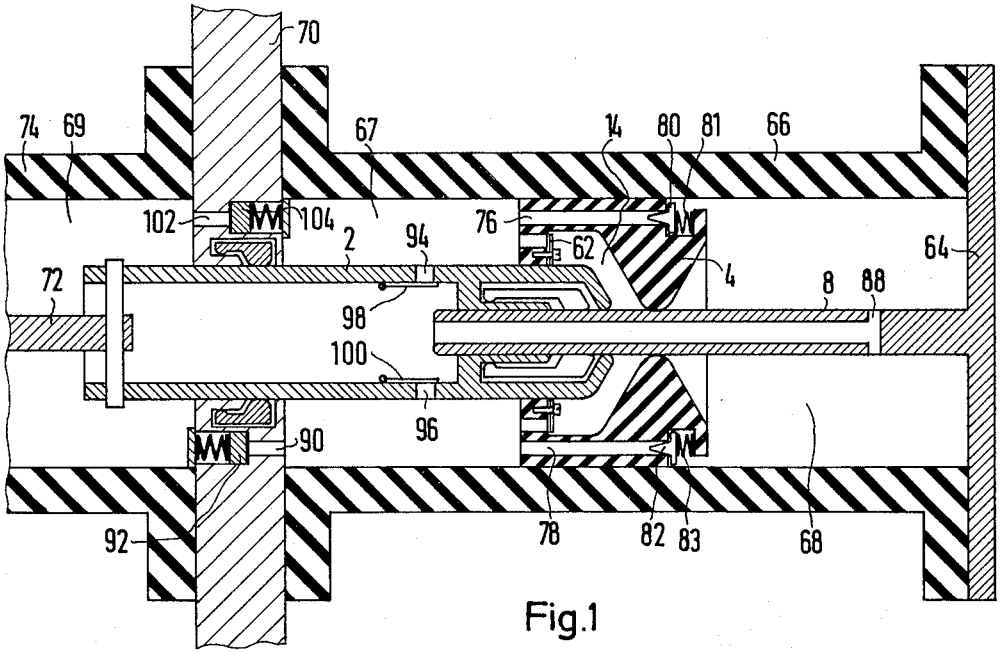
FIG. 1 is a cross-sectional view illustrating a first embodiment of the present invention.

FIG. 1 illustrates, in cross-section, a blast piston circuit breaker having installed therein the overflow arrangement of the present invention. In the arrangement of FIG. 1 a movable electrode 2 is suitably supported in a partition 70 and is coupled to a drive shaft 72 which is arranged to move it in and out of contact with a fixed contact 8. The fixed contact 8 is an extension of the end portion 64 of the arrangement. In the illustrated embodiment the movable electrode 2 is hollow as is the fixed electrode 8. It should be recognized however that a solid electrode 8 may also be used. Rigidly secured to the movable contact 8 is an insulating part 4. The insulating part 4 contains check valves 62 which may comprise resilient reeds in the manner described in the aforementioned co-pending application. The check valves 62 are contained within flow canals 14 which couple a high pressure chamber 67 to the quenching area for quenching the arc when the circuit breaker is opened. The partition 70 separates the high pressure chamber 67 from a low pressure chamber 69 and a low pressure chamber 68. The quenching arrangement itself is enclosed within a cylindrical insulating member 66. A further cylindrical insulating member 74 on the other side of the partition 70 encloses the drive rod 72 used for driving the circuit breaker. The insulating portion 4, which is noted above is securely affixed to the movable contact 2, has a nozzle-like shape. The outer surface of the insulating part 4 slides within the hollow-cylindrical member 66. Its inner edge at the nozzle portion is in sliding contact with the fixed electrode 8. In operation, as the movable contact is moved to the left to disengage it from contact with the fixed contact 8 and open the circuit breaker, the insulating part moves therewith and acts as a piston to compress the gas within the high pressure chamber 67. Compression continues but no gas flows until the fixed and movable contacts are separated and the flow canal 14 is opened. In this sense the fixed contact 8 has an action like that of a valve keeping the flow canal closed until the contacts are separated and an arc is drawn. In accordance with the present invention there are also installed in the insulating part 4 overflow channels 76 and 78 having installed therein pressure relief valves. The pressure relief valve for the bypass or overflow channel 76 comprises the valve cap 80 which seats against the end of the channel and is maintained in place by a spring 81. Similarly the pressure relief valve for the channel 78 comprises the valve cap 82 and spring 83. In conventional fashion, the springs 81 and 83 will be selected to cause the valve caps 80 and 82 to seat with the required predetermined pressure at which it is desired that the relief valves release.

The drawing illustrates the arrangement with the contact closed. As shown, the movable contact 2 has a hollow contact portion extending over and gripping the fixed contact 8 in conventional fashion. In the illustrated embodiment, the contact 8 is made as a hollow contact and has a hole or port 88 extending therethrough in communication with its hollow portion. By means of this arrangement pressure equalization between the low pressure chamber 68 and the low pressure chamber 69 takes place. That is, there is direct communication through the port 88, the hollow portion of the fixed contact 8 and the hollow portion of the movable contact 2 to equalize pressure between the two chambers.

When the movable contact 2 is moved to the left to interrupt the current, the quenching gas such as $SF_6$ in the high pressure chamber 67 will be compressed by the insulating part 4 acting as a piston. Typically the gas in the chamber will be under a pressure of $p_o = 10^6$ $N/m^2$ prior to compression. As soon as the movable electrode 2 slides beyond the end of the fixed electrode 8 an arc will be drawn between the two electrode ends. At essentially the same time the flow canal 14 will be opened and the pre-compressed quenching gas will flow from the high pressure chamber 67 through the flow canal 14 to the arc quenching gap and then into the low pressure chambers 68 and 69. Since at this point there has been no excess pressure generated the necessary pressure differential will exist and the check valve 62 will open. As is well known, a great deal of heat will be generated by the arc between the two electrodes. This will cause the pressure in the quenching gap to increase to the point where it is greater then the pressure in the high pressure chamber 67. This back pressure will then cause the check valve 62 to close preventing a return flow of the hot gases into the compression chamber 67.

The motion of the electrode 2 is normally determined only by the required blasting or quenching time. Typically this is in the order to 20 msec. Thus, even after a back pressure is generated closing the check valve 62, the electrode 2 and the insulating part 4 acting as a piston will continue to move to the left further compressing the gas in the space 67. Compression will continue until the pressure in that chamber again exceeds the pressure at the quenching gap. However, the pressure in the quenching gap can reach a value which is more than three times the initial pressure. As a result, the check valve 62 can remain closed for a considerable portion of a current half-wave. As a result if no further measures are taken the drive mechanism for the movable contact 2 and insulating part 4 acting as the blasting piston which engages the drive rod 72 must be designed to provide for the large amount of compression work which takes place in the high pressure chamber of the quenching arrangement.

The overflow channels 76 and 78 and their associated pressure relief valves of the present invention avoid the necessity of such an over-design. In accordance with the present invention, the spring force of the compression springs 81 and 83 is selected or adjusted so that the pressure relief valve will open at a predetermined over-pressure in the high pressure chamber 67. Typically this can be a pressure 1.5 $p_o$ to 2 $p_o$ where $p_o$ is the initial gas pressure described above. This will enable a portion of the quenching gas to escape from the high pressure chamber 67 into the low pressure chamber 68. It will bypass the quenching gap in which the arc is burning. As a result the quenching gas can continue to escape until the pressure within the high pressure chamber 67 falls below the the preselected value for these pressure relief valves. Once the back pressure generated at the arc falls below the pressure in the high pressure chamber 67, the check valve 62 will open and gas will again flow through the flow canal 14 to quench the arc. Through the provisions of the present invention the pressure in the high pressure section 67 of the quenching arrangement will be limited to a predetermined value which should not exceed 2 or 2.5 $p_o$ where $p_o$ is the stationary initial pressure in the entire quenching arrangement referred to above.

In the illustrated embodiment the caps 80 and 82 at the end of the overflow channels 76 and 78 are made as pressure relief valves through the use of compression springs. It will be recognized by those skilled in the art that other types of relief valves may equally well be used. For example, the relief valves may be in the form of resilient needs. Furthermore overflow channels may be disposed in other portions of the arrangement. It is only necessary that the overflow channels form a path which parallels the quenching gap and enables the gas to flow from the high pressure chamber 67 to the low pressure chambers 68 and 69. Thus, overflow canals may also be provided establishing a direct connection from the high pressure chamber 67 to the low pressure chamber 69. Such a channel can be formed in the partition 70 which is used to separate these two chambers and which is used to guide the movable electrode 2. An overflow channel 90 of this type is illustrated at the bottom of this partition, the channel 90 having a spring loaded pressure relief valve 92.

It is also possible to install pressure relief valve and overflow channels in the cylinder wall of the movable electrode. Such is illustrated by the overflow channels 94 and 96 with associated resilient reed pressure relief valves 98 and 100.

Once the breaker has opened and is again closed, it will of course be necessary to replenish the gas supply in the high pressure chamber 67. Note that with the arrangement shown, gas will not normally flow back from the low pressure chamber 68 and 69 into the high pressure chamber 67. To provide for such replenishment, a gas supply canal 102 with an associated check valve 104 is provided. Through this arrangement, should the pressure in the high pressure chamber at any time fall below the pressure in the low pressure chambers 68 and 69, gas will flow through the canal 102 and valve 104 into the chamber 67. Of course, the valve will not permit flow in the other direction.

Figure 2:
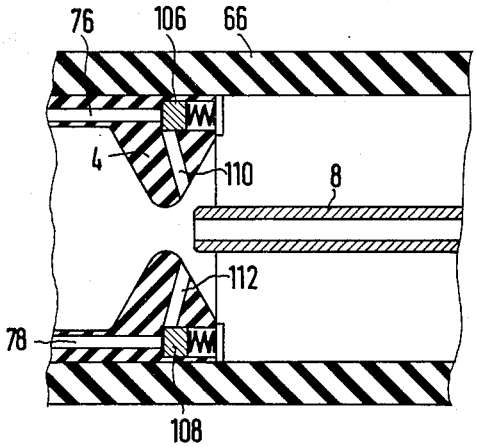
FIG. 2 is a partial view illustrating a further embodiment according to the present invention.

FIG. 2 illustrates an alternate embodiment of the present invention. In most respects, the arrangement will be essentially as in FIG. 1. The difference is in the placement of the overflow channels. In FIG. 2, which shows only a portion of the circuit breaker and shows the arrangement with the contact separated, it is assumed that an arc has been drawn and is extending from the fixed contact 8 toward the movable contact 2 which is not specifically shown. It is further assumed that a back pressure has been generated closing off the check valves. In this illustrated embodiment the overflow chambers 76 and 78 again terminate in pressure relief valves. However, in this embodiment the pressure relief valves designated as 106 and 108 discharge not directly to the low pressure chamber 68 but rather to canals 110 and 112 which terminate on the low pressure side of the insulating part 4 in the area of the quenching gap. These terminate close to the pointed ends of the insulating part. Under a condition of back pressure, there will be a gas flow through the nozzle-like portion of the insulating part 4 from the left to the right. The canals 110 and 112 are on the downstream side of this flow and their termination above the end of the nozzle places them in the shadow of the flow. Preferably a plurality of channels, such as the channels 110 and 112 will be distributed over the circumference of the insulating part 4 with approximately equal spacing. As soon as the pressure in the high pressure chamber 67 increases above the predetermined value, the relief valves 106 and 108 will open and the gas will escape through the canals 110 and 112 to a point directly behind the narrow nozzle portion and will act to blast the burning arc at that point. The arrangement and orientation of these overflow canals 110 and 112 is selected so that overflowing cold quenching gas discharges into the immediate proximity of the arc in the shadow of the narrow portion of the insulating part 4 which acts as a quenching nozzle. This discharging quenching gas prevents hot plasma clouds from forming in the shadow of the quenching nozzle flow which could have an adverse effect on the quenching of the arc and could promote re-arcing.

Thus, an improved arc quenching arrangement in a piston type gas flow circuit breaker in which overflow channels are provided to prevent excess pressure build-up has been shown. Although specific embodiments have been illustrated and described, it will be obvious to those skilled in the art that various modifications may be made without departing from the spirit of the invention which is intended to be limited solely by the appended claims.

What is claimed:

1. An arrangement for quenching an arc in a gas flow circuit breaker such as a blasting piston circuit breaker in which a flow canal with a check valve is provided, the flow channel leading through an insulating part to a quenching gap, with quenching gas flowing from a high pressure chamber to a low pressure chamber across the quenching gap, wherein the improvement comprises an overflow channel establishing a path from the high pressure chamber to the low pressure chamber which parallels the path between these two chambers across the quenching gap, and a pressure relief valve in said overflow channel.

2. An arrangement according to claim 1 wherein said circuit breaker includes a fixed and a movable contact, said overflow channel and said check valve are disposed in the insulating part and wherein said insulating part is mounted to the movable electrode and is adapted to act as the blasting piston for generating a high pressure in said high pressure chamber.

3. An arrangement according to claim 2 wherein said insulating part has a nozzle-like profile and wherein said overflow channel terminates on the low pressure side of said insulating part in the immediate proximity of the quenching gap and in the shadow of the flow through the nozzle-like profile construction in the insulating part.

4. The arrangement according to claim 1 wherein said relief valves comprise resilient reeds.

5. The arrangement according to claim 1 wherein said relief valves comprise a closing cap over the end of the an overflow channel and spring means pressing said closing cap against the end of said channel with a predetermined force.

6. The arrangement according to claim 1 wherein one of said fixed and movable electrodes is an electrode having the shape of a hollow cylinder with its interior communicating with said low-pressure section and said overflow canal and said relief valve are located in the cylinder wall of said one electrode.

7. The arrangement according to claim 6 wherein said one electrode shaped as a hollow cylinder is arranged to engage the other electrode, said other electrode also being hollow and provided with at least one opening from its outside surface to its inner hollow portion.

8. The arrangement according to claim 1 wherein said overflow channel containing a pressure relief valve is located in a partition between said high pressure chamber and said low pressure chamber.

9. The arrangement according to claim 1 and further including a replenishment channel containing a check valve for replenishing the gas within said high pressure chamber after said quenching arrangement is closed.

* * * * *